United States Patent [19]

Piche

[11] Patent Number: 4,471,958

[45] Date of Patent: Sep. 18, 1984

[54] RACKET CONCENTRATION AID

[76] Inventor: Richard Piche, 443 Saint-Louis St., Joliette, Canada, J6E 2Y7

[21] Appl. No.: 449,062

[22] Filed: Dec. 13, 1982

[51] Int. Cl.[3] ..... A63B 49/00

[52] U.S. Cl. ..... 273/73 R; 273/29 A

[58] Field of Search ..... 273/73 R, 67 R, 73 C, 273/29 R, 73 D, 29 A, 183 D, 186 A, 186 C; D21/210–212, 198

[56] References Cited

U.S. PATENT DOCUMENTS

| | | | |
|---|---|---|---|
| 2,094,536 | 9/1937 | Heimers | 273/29 A X |
| 2,732,209 | 1/1953 | Forbes . | |
| 3,545,756 | 6/1968 | Nash . | |
| 4,076,239 | 2/1978 | Hall . | |
| 4,141,549 | 2/1979 | Hayes et al. | 273/73 D X |
| 4,162,791 | 7/1979 | Sechase . | |
| 4,189,142 | 2/1980 | de Vries . | |

*Primary Examiner*—Richard C. Pinkham

*Assistant Examiner*—Matthew L. Schneider

[57] ABSTRACT

A concentration aid for strung rackets used in various sports wherein the object is to hit a projectile, comprising a racket having a head portion provided with a netting matrix, and a handle; a bead made of rigid aesthetic material and having a through-bore. The bead is located in one of the as square openings of the "sweet spot" area of the netting and is held in place by a pair of strings under slight tension and passing through the through-bore and extending on either side thereof, having their opposite ends fastened to the racket frame or to the matrix netting. A projectile striking the bead produces a distinctive vibration felt in the player's forearm thereby helping him or her to properly localize the "sweet spot". The bead does not deviate the trajectory of the projectile on either forehand or backhand strokes of the racket since it is free to retract within the netting opening when struck by the projectile.

5 Claims, 6 Drawing Figures

FIG. 6
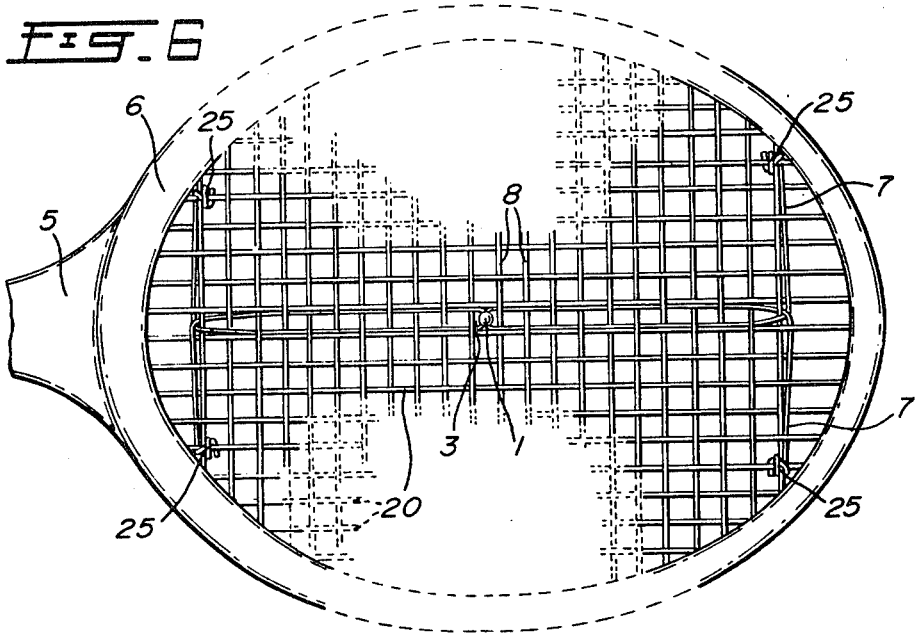
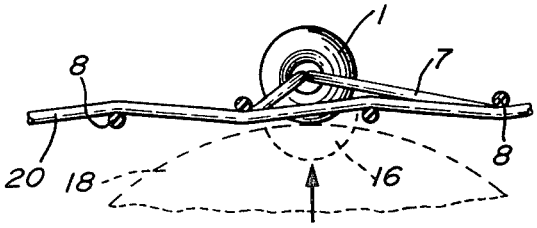
FIG. 4
FIG. 5
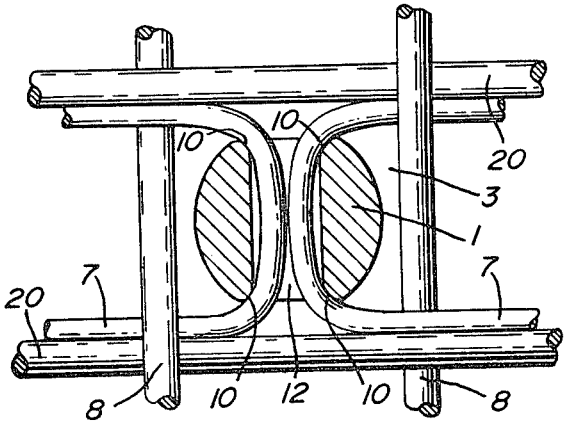

RACKET CONCENTRATION AID

FIELD OF THE INVENTION

The present invention relates to stringed rackets used in games such as tennis, racquet ball, squash or badminton, more specifically to a concentration aid to be used with any standard racket by players practising and/or playing the various racket sports.

BACKGROUND OF THE INVENTION

Stringed rackets in common usage for the various above-mentioned sports all have a head portion comprised of an elliptical, oval or circular frame and a matrix formed of a plurality of transverse and longitudinal strings, the latter being disposed along, and parallel to, the axis of the racket handle. The area of the matrix defined by the intersection of the longest transverse and longitudinal strings is known among racket sportsmen as the "sweet spot".

This "sweet spot" is so-called because it is the only area of the strings to produce the highest velocity and most certainty as to the flight path of a projectile (such as a tennis ball) when the projectile is hit by the racket; hence the area of greatest satisfaction.

Accordingly the prior art has attempted to provide a racket which is provided with means to make the hitting of the "sweet spot" easier as one practices. For example U.S. Pat. No. 3,545,756 to Nash teaches a racket head having string attachment rod sections of varying resiliency thereby enlarging the surface area of the "sweet spot". Another U.S. Pat. No. 4,076,239 to Hall uses a pair of flat plates secured on each side of the netting matrix in the area of the "sweet spot" which are adapted to make a distinctive sound when the projectile strikes them. This arrangement is thus an audible aid for the player. Yet another U.S. Pat. No. 4,151,549 issued to Hayes et al Feb. 27, 1979, disclosed a signal device which similarly makes a noise when struck.

With the exception of the first above-cited patent, the prior art teaches rackets which rely on ear-hand coordination for improved hitting on the "sweet spot". This might be confusing for some players more accustomed to visual-muscular coordination. A further disadvantage would be that such rackets could not be used by players who are hard of hearing or deaf.

OBJECTS OF THE INVENTION

In view of the above, it is a prime object of the present invention to provide a racket concentration aid consisting of a small bead attached to the "sweet spot" area which, when struck, causes a distinctive vibration in the racket which is transmitted to the forearm of the player.

It is another object of the invention to provide a racket concentration aid which is aesthetic and personal.

It is another object of the invention to provide an aid of the character described which does not affect the return flight path of the struck projectile.

SUMMARY OF THE INVENTION

The above and other objects and advantages of the instant invention are realized according to a preferred embodiment comprising a racket having a handle and a head portion strung with longitudinal and intersecting lateral strings in the known manner. The invention proper consists of a bead made of rigid material and preferably spherical in shape, having a through-bore. This bead is adapted to be held in position in one of the sweet spot central square openings formed by the intersecting strings of the racket.

The bead is held in position by at least one string passing through the bore and having its opposite ends tied to the racket head adjacent the bead frame. The string is preferably of substantially smaller diameter than the standard netting matrix strings because it is not necessary to provide any tension on the string.

The string is woven into the matrix in over-under relationship in the same way as its adjacent lateral string and extends alongside the same. In one embodment, the string extends through the bead and its ends are attached to opposed portions of the head relative to the bead.

In a second embodiment of the invention, there are two strings looped through the bead. Both ends of each string are attached to the head in a same zone which is opposite to the attachment zone of the two ends of the other string.

It has been found that a projectile such as a tennis ball hitting the bead causes a distinctive vibration in the head portion of the racket which is immediately transmitted to the forearm of the user through the handle. Thus a player will quickly learn where the "sweet spot" is, consequently improving his or her swing.

Yet the bead will not cause the projectile to deviate from its flight path because of the lack of tension of the string or strings which hold the bead in place: under the impact of the projectile the bead is resiliently pushed in the same direction as the incoming projectile through its square hole area to the opposite side of the netting. When the projectile leaves the matrix the bead bounces back into position.

Preferably the through-bore of the bead extends transversely of the racket head in both embodiments as will be explained herebelow.

BRIEF DESCRIPTION OF THE DRAWINGS

The above will be more clearly understood by having referral to the preferred embodiments of the invention, illustrated by way of the accompanying drawings, in which:

FIG. 4 is an enlarged top plan view of the central square area also showing the bead in cross-section, as well as the attachment strings in accordance with a second embodiment;

FIG. 5 is a lateral elevation of the bead in displaced position, also showing a tennis ball and the initial position of the bead in dashed outline; and FIG. 6 is a top plan view of the head portion of a racket equipped with the bead according to the second embodiment of the invention.

Like numerals refer to like elements throughout the drawings.

DETAILED DESCRIPTION OF THE INVENTION

Figure 1:
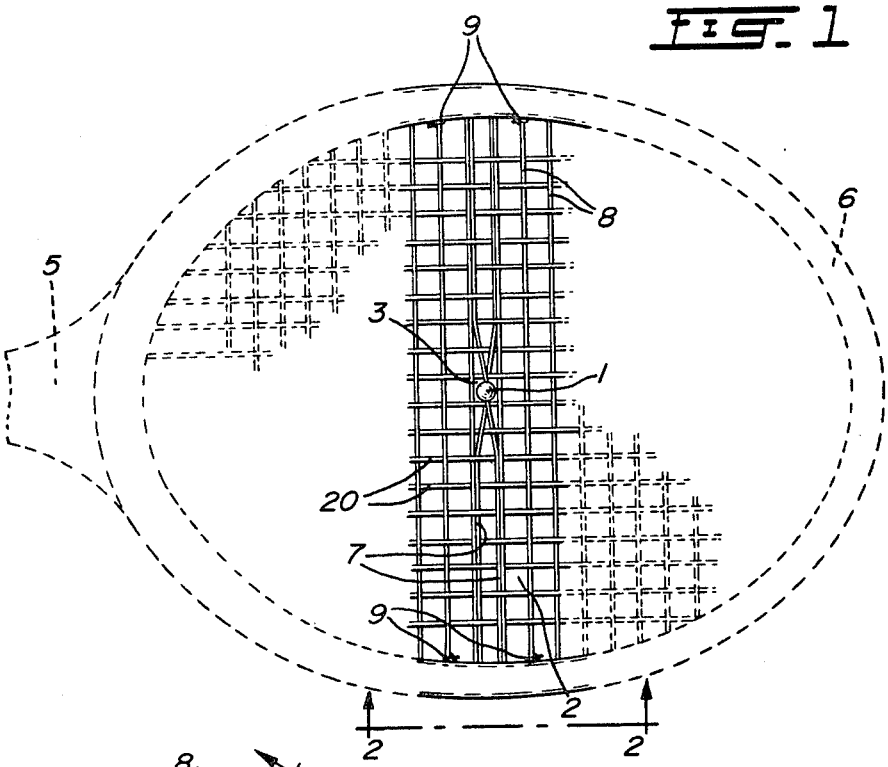
FIG. 1 is a top plan view of a racket head portion in dashed outline, also showing a central portion of the netting matrix and the bead according to one embodiment of the invention.

Referring to FIG. 1, there is shown a racket (such as a tennis racket) having a handle 5 and a head portion consisting of a generally oval frame 6 and a netting matrix formed of a plurality of lateral strings 8 and a plurality of longitudinal strings 20 which intersect the latter in over-under relationship according to the usual stringing patterns of rackets.

The intersecting strings 8 and 20 of the matrix define a plurality of substantially square holes 2 including a central square 3 in the "sweet spot" area.

Figure 2:
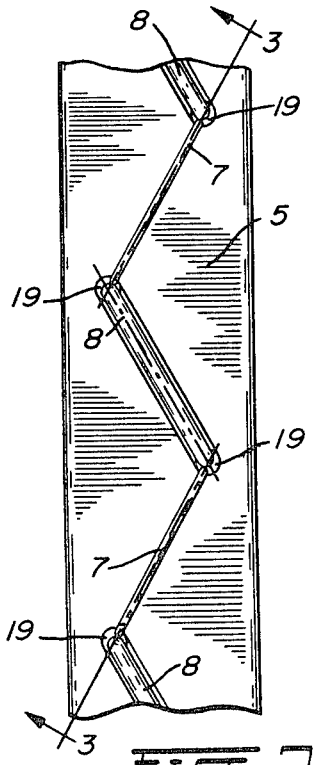
FIG. 2 is a side elevation taken along line 2—2 of FIG. 1.
Figure 3:
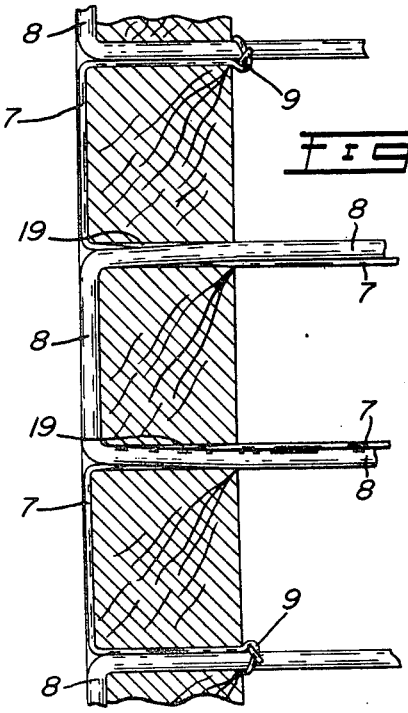
FIG. 3 is a cross-sectional view taken along lines 3—3 of FIG. 2.

The lateral sides of the racket frame 6 are provided with spaced-apart through-holes 19 which are adapted to receive strings 8 loop by loop as seen clearly in FIG. 3. FIG. 2 illustrates how the holes 19 are made in zigzag relationship in the frame 6 as well as the surface slots made in the latter according to the usual manner.

The space of central square 3 is occupied by a bead 1 which is preferably spherical as shown but which can be made in other shapes and different colours. Bead 1 is preferably made of metal such as gold or silver alloys; but it can also be a precious stone such as a diamond for aesthetic or personal preferences of the racket owner.

Referring to FIG. 1 there is shown how bead 1 is maintained in square 3 by means of two strings 7, each of which pass through a through-bore 12 made in bead 1 (see FIG. 4). Referring to FIGS. 1, 2 and 3, each string 7 extends laterally on either side of bead 1 adjacent one of the standard strings 8 in the same over-under relationship as the latter. Strings 7 are of substantially smaller diameter and of significantly lower tension than strings 8 and 20, as fastened to the lateral sides of frame 6, seen clearly in FIGS. 2 and 3, and as indicated at 9, after passage through two adjacent holes 19.

FIG. 6 shows a second embodiment according to which strings 7 are disposed longitudinally instead of laterally. Instead of passing directly through bore 12 each string 7 is looped through bore 12 and extends away from bead 1 adjacent strings 20 in over-under relationship as in the first embodiment. At the outer and inner portions of the netting matrix each string 7 is extended laterally and tied at 25. This embodiment provides a way to attach strings 7 in rackets wherein the standard strings 8 pass through dowel-like elements (not shown) fitted in holes 19 of frame 6 thereby preventing the passing of strings 7 through holes 19. FIG. 4 shows how the edges of through-bore 12 are rounded at 10, to prevent the abrasion of strings 7. FIGS. 1 and 6 show that bead 1 is smaller in size than that of square holes 2, so that it is free to move through said hole. FIG. 5 clearly shows that, in its normal position, bead 1 protrudes from both sides of the netting matrix.

Strings 7 are made preferably of nylon and are provided in pairs to reduce the risk of losing bead 1 in case one of the strings 7 breaks. In the first embodiment, through-bore 12 is oriented with the main extent of strings 7 while in the second embodiment, the through-bore 12 is transverse to the main extent of strings 7. It will be readily apparent that the arrangement of FIG. 6 (the second embodiment) will make bead 1 less resilient when struck by a projectile such as a tennis ball 18 (cf. FIG. 5) because strings 7 of FIG. 6 have more free play in square 3 than the strings 7 of FIG. 1. In other words strings 7 are turned at a right angle to bore 12 wherein the lengths of strings 7 between the openings of bore 12 and the intersecting racket strings 20 of central square 3 are substantially increased relative to FIG. 1. Consequently the resilience of bead 1 can be varied according to whether strings 7 are generally parallel to, or at a right angle to, the through-bore 12. This feature is to suit individual player preferences.

It is to be noted that bead 1 will cause a distinctive vibration for both forehand and backhand strokes since it simply moves away from the projectile under the impact of the latter towards the opposite side of the netting matrix.

What I claim is:

1. A racket suitable for propelling a game projectile, said racket having a head portion and a handle portion, said head portion including a frame member defining an included area and a plurality of longitudinal and intersecting lateral strings forming a netting matrix extending within said included area and secured to said frame member under a predetermined tension, said strings defining a plurality of substantially square openings; the longest of said longitudinal and the longest of said lateral strings defining a "sweet spot" area of said openings; a bead made of rigid material, of a size smaller than that of said square openings and located in one of said openings in said "sweet spot" area in a normal position in which said bead protrudes from both sides of said netting matrix, said bead having a through bore, at least one bead string passing through said through bore and extending away from said bead on either side thereof, said bead string being woven into said netting matrix and fastened to said head portion at its opposite ends, said bead string being under significantly less tension than said predetermined tension, said bead string tension being low enough to enable said head to temporarily yieldingly move within said one of said openings when hit by said projectile, but high enough to normally resiliently maintain said bead in said normal position.

2. A racket concentration aid as defined in claim 1 wherein said bead is located in the central square opening of said "sweet spot" area.

3. A racket concentration aid as defined in claim 2 wherein there are two strings passing through said through-bore.

4. A racket concentration aid as defined in claim 3 wherein the portions of said two strings adjacent said bead are generally parallel to said through-bore.

5. A racket concentration aid as defined in claim 3 wherein said two strings are turned at a right angle to said through-bore and in said central square, each string being looped in opposite directions.

* * * * *